US009840950B2

(12) United States Patent
Yoshijima et al.

(10) Patent No.: US 9,840,950 B2
(45) Date of Patent: Dec. 12, 2017

(54) OIL PAN

(71) Applicants: TOYOTA JIDOSHA KABUSHIKI KAISHA, Toyota-shi (JP); UCHIYAMA MANUFACTURING CORP., Okayama-shi (JP)

(72) Inventors: Kazuya Yoshijima, Okazaki (JP); Naohiro Hayashi, Miyoshi (JP); Naohisa Miyashita, Nagoya (JP); Daisuke Uotani, Sanda (JP); Hiroyuki Sato, Motosu-gun (JP); Naoto Matsubara, Akaiwa (JP); Kenji Takeuchi, Amagasaki (JP)

(73) Assignees: TOYOTA JIDOSHA KABUSHIKI KAISHA, Toyota-shi (JP); UCHIYAMA MANUFACTURING CORP., Okayama-shi (JP)

( * ) Notice: Subject to any disclaimer, the term of this patent is extended or adjusted under 35 U.S.C. 154(b) by 12 days.

(21) Appl. No.: 14/769,623

(22) PCT Filed: Jun. 27, 2014

(86) PCT No.: PCT/JP2014/067156
§ 371 (c)(1),
(2) Date: Aug. 21, 2015

(87) PCT Pub. No.: WO2014/208720
PCT Pub. Date: Dec. 31, 2014

(65) Prior Publication Data

US 2016/0010521 A1 Jan. 14, 2016

(30) Foreign Application Priority Data

Jun. 27, 2013 (JP) ..... 2013-135211

(51) Int. Cl.
*F01M 11/00* (2006.01)
*F02F 7/00* (2006.01)
(Continued)

(52) U.S. Cl.
CPC ..... *F01M 11/0004* (2013.01); *F01M 11/00* (2013.01); *F02F 7/00* (2013.01);
(Continued)

(58) Field of Classification Search
CPC ..... F01M 11/0004; F01M 11/00; F01M 2005/023; F01M 2011/0037; F01M 2011/0062; F02F 7/00
(Continued)

(56) References Cited

U.S. PATENT DOCUMENTS 2,475,836 A * 7/1949 Henricksen ..... F02B 77/00 184/106
2,837,063 A * 6/1958 Martinez ..... F02B 77/00 123/195 C
(Continued)

FOREIGN PATENT DOCUMENTS

EP 2 749 741 A2 7/2014
JP 5-306654 A 11/1993
(Continued)

OTHER PUBLICATIONS

International Search Report dated Aug. 12, 2014, in PCT/JP2014/067156 filed Jun. 27, 2014.

*Primary Examiner* — Michael Riegelman
(74) *Attorney, Agent, or Firm* — Oblon, McClelland, Maier & Neustadt, L.L.P.

(57) ABSTRACT

A double sump oil pan includes a separator made of plastic that partitions the interior of the oil pan into an inner sump and an outer sump, a plate, and an elastically deformable sealing member attached to the plate. The sealing member
(Continued)

closely contacts the inner wall of the oil pan and seals the outer sump. The plate and the separator are fixed to each other.

12 Claims, 1 Drawing Sheet

(51) Int. Cl.
*F01M 5/02* (2006.01)
*F01M 11/02* (2006.01)

(52) U.S. Cl.
CPC ..... *F01M 2005/023* (2013.01); *F01M 2011/0033* (2013.01); *F01M 2011/0037* (2013.01); *F01M 2011/0062* (2013.01); *F01M 2011/023* (2013.01)

(58) Field of Classification Search
USPC ..... 184/106
See application file for complete search history.

(56) References Cited

U.S. PATENT DOCUMENTS 3,678,914 A * 7/1972 Vulliamy ..... F02F 7/008 123/195 C
4,294,333 A * 10/1981 Little ..... F01M 11/04 123/195 C
4,394,853 A * 7/1983 Lopez-Crevillen ..... F01M 11/0004 123/195 C
4,492,189 A * 1/1985 Ogawa ..... F02B 77/13 123/195 C
4,519,348 A * 5/1985 Hamilton ..... F01M 11/0004 123/195 C
4,667,628 A * 5/1987 Lopez-Crevillen ..... F01M 11/0004 123/195 C
4,719,892 A * 1/1988 Lopez-Crevillen ..... F02B 77/13 123/195 C
4,997,193 A * 3/1991 Czernik ..... F16J 15/122 123/198 E
5,121,932 A * 6/1992 Goldman ..... F16J 15/127 123/90.37
5,375,569 A * 12/1994 Santella ..... B29C 45/1676 123/195 C
5,536,018 A * 7/1996 Szott ..... F16J 15/104 277/313
5,934,686 A * 8/1999 Ottenschlager .... F01M 11/0004 123/195 C
6,112,856 A * 9/2000 Wilson ..... F16N 31/002 184/106
7,631,630 B2 * 12/2009 Sedlar ..... F02F 7/006 123/195 C
9,447,920 B2 * 9/2016 Wilson ..... F16N 31/006
2003/0024768 A1 * 2/2003 Jones ..... F01M 11/0004 184/1.5
2010/0066033 A1 * 3/2010 Jessberger ..... F01M 11/0004 277/591
2016/0222846 A1 * 8/2016 Mizoguchi ..... F02F 11/00

FOREIGN PATENT DOCUMENTS

JP 9-280029 A 10/1997
JP 2006-112326 A 4/2006
JP 2008-303720 A 12/2008
JP 2010-96062 A 4/2010
JP 2011-226394 A 11/2011
JP 2013-104362 A 5/2013
JP 2014-125966 A 7/2014

* cited by examiner

OIL PAN

TECHNICAL FIELD

The present invention relates to a double sump oil pan having an inner sump and an outer sump.

BACKGROUND ART

Conventionally, double sump oil pans have been known, which include a separator installed therein to partition the interior into an inner sump and an outer sump from each other. Refer, for example, to Patent Document 1. In such an oil pan, only the oil that is stored in the inner sump is circulated after the engine is started to quickly increase the temperature of the oil, thereby reducing friction at parts requiring lubrication.

PRIOR ART DOCUMENT

Patent Document

Patent Document 1: Japanese Laid-Open Patent Publication No. 2011-226394

SUMMARY OF THE INVENTION

Problems that the Invention is to Solve

When oil is used for lubrication of an internal combustion engine, the oil temperature is increased. The heated oil then trickles down the inner wall of the cylinder block. When such trickled oil enters the outer sump, the amount of oil returned to the inner sump is reduced. This delays increase in the temperature of the oil in the inner sump.

Accordingly, it is an objective of the present invention to provide an oil pan that restricts oil trickling down the inner wall of a cylinder block from entering an outer sump, thereby allowing the oil in the inner sump to be easily heated.

Means for Solving the Problems

To achieve the foregoing objective and in accordance with one aspect of the present invention, a double sump oil pan is provided that includes a separator made of plastic that partitions an interior of the oil pan into an inner sump and an outer sump, a plate, and an elastically deformable sealing member attached to the plate. The sealing member closely contacts an inner wall of the oil pan, thereby sealing the outer sump. The plate and the separator are fixed to each other.

According to the above configuration, when the separator is installed in the oil pan, the sealing member is elastically deformed to closely contact the inner wall of the oil pan, thereby sealing the outer sump. This restricts oil trickling down the inner wall of the cylinder block from entering the outer sump, thereby allowing the oil in the inner sump to be easily heated.

Depending on the shape or the size of the separator, the sealing member cannot be directly attached to the separator in some cases. In this regard, the above described configuration includes a plate that is smaller in size than the separator and is easy to handle, and the sealing member for sealing the outer sump is attached to the plate. The plate with the sealing member is fixed to the separator. This allows the sealing member to be easily attached to the separator.

In such a configuration, the separator preferably has a protrusion, and the plate preferably has an insertion hole, which receives the protrusion. Also, the plate and the separator are preferably fixed to each other by heat-swaging the protrusion. This allows the sealing member to be arranged at a desired position on the separator.

The sealing member of the double sump oil pan is preferably a rubber lip. The rubber lip is easily elastically deformed to conform to the shape of the inner wall of the outer sump, thereby further closely contacting the inner wall. This further improves the sealing property of the outer sump.

In the double sump oil pan, the plate preferably has a ring-like shape, and the sealing member is preferably attached to an entire perimeter of the plate. This improves the sealing property of the outer sump, thereby allowing the oil to be more easily heated.

MODES FOR CARRYING OUT THE INVENTION

A double sump oil pan according to one embodiment will now be described with reference to FIGS. 1 and 2.

Figure 1:
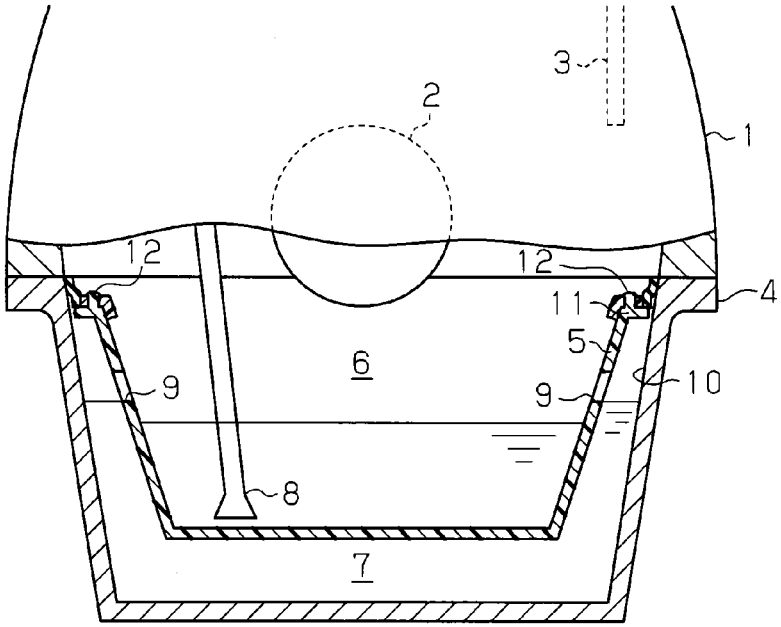
FIG. 1 is a cross-sectional view schematically illustrating the structure of an oil pan.

As shown in FIG. 1, a cylinder block 1 of an internal combustion engine includes a crankshaft 2 and an oil drain passage 3. An oil pan 4 is attached to the bottom of the cylinder block 1. The oil pan 4 has such a shape that the distance between the opposed faces of an inner wall 10 decreases toward the lower end. A box-shaped separator 5 with an open upper end is installed in the oil pan 4. The separator 5 is made of plastic.

The separator 5 divides the interior of the oil pan 4 into an inner sump 6 and an outer sump 7. The inner sump 6 accommodates an oil strainer 8, which pumps up stored oil. The separator 5 has through holes 9 in the side walls to connect the inner sump 6 and the outer sump 7 to each other. The separator 5 further has a flange 11, which protrudes outward from the upper end, that is, toward the inner wall 10 of the oil pan 4. The flange 11 extends over the entire perimeter of the separator 5. The flange 11 has protrusions 12, which are arranged at intervals along the perimeter.

Figure 2:
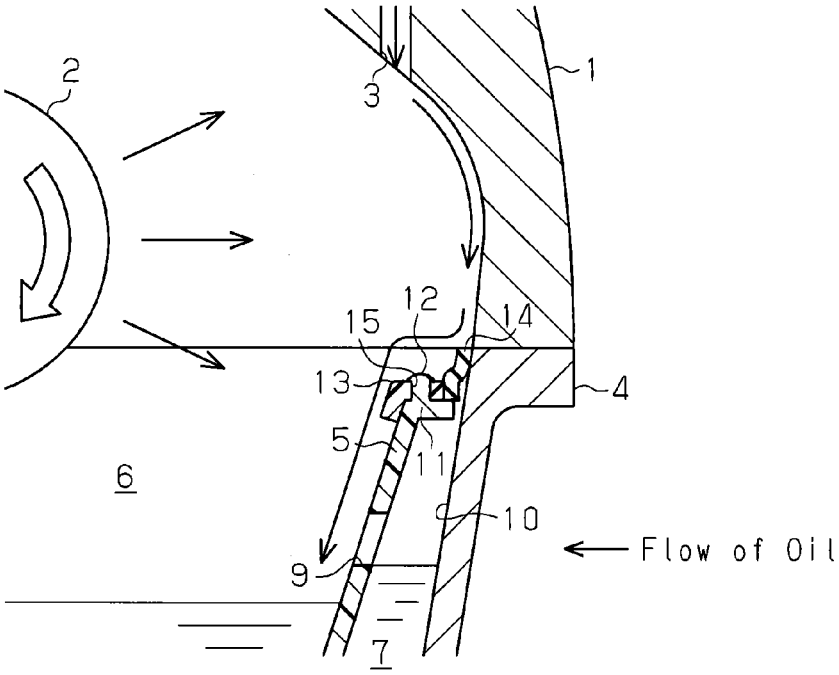
FIG. 2 is a cross-sectional view schematically illustrating flow of oil in the oil pan.

As shown in FIG. 2, the separator 5 has, at its upper end, a ring-shaped plate 13, which is made of plastic and extends over the entire perimeter. A sealing member, which is a rubber lip 14, is attached to the outer side of the plate 13 to extend over the entire perimeter of the plate 13. The rubber lip 14 extends upward from the plate 13. The upper part of the rubber lip 14 closely contacts the inner wall 10 of the oil pan 4. This seals the outer sump 7. The rubber lip 14 can be attached to the plate 13, for example, by injection molding.

The plate 13 has insertion holes 15, which are arranged at intervals along the perimeter. The insertion holes 15 each receive one of the protrusions 12 of the separator 5. The protrusions 12 are heat-swaged so that the distal ends of the protrusions 12 and the upper surface of the flange 11 hold the plate 13, so that the plate 13 is fixed to the separator 5.

Operation of the oil pan 4 having the above described structure will now be described.

After the engine is started, the oil pump is activated to pump up oil from the inner sump 6 via the oil strainer 8. The pumped-up oil lubricates engine components and is heated. Thereafter, the oil is returned to the oil pan 4 via the oil drain passage 3 and an oil passage formed inside the crankshaft 2. Some of the oil is scattered by rotation of the crankshaft 2 and trickles down the inner wall of the cylinder block 1 to be returned to the oil pan 4.

In the present embodiment, the rubber lip 14, which is attached to the plate 13, seals the outer sump 7. Therefore, as shown in FIG. 2, oil that has trickled down the inner wall of the cylinder block 1 does not flow into the outer sump 7, but enters the inner sump 6. As a result, the temperature of the oil in the inner sump 6 is quickly increased.

When the engine is stopped, pumping up of oil is stopped and oil that has lubricated engine components is returned to the inner sump 6. This raises the level of the oil stored in the inner sump 6, so that some of the stored oil flows to the outer sump 7 through the through holes 9. Since oil flows from the inner sump 6 to the outer sump 7 and is dispersed, deterioration of the oil in the inner sump 6 is reduced.

Depending on the shape or the size of the separator 5, the rubber lip 14 cannot be directly attached to the separator 5 in some cases. In this regard, the present embodiment includes the plate 13, which is smaller in size than the separator 5 and is easy to handle, and the rubber lip 14 for sealing the outer sump 7 is attached to the plate 13. The plate 13 is fixed to the separator 5 by heat-swaging. This allows the rubber lip 14 to be easily attached to a desired position on the separator 5.

When attaching the separator 5, to which the plate 13 is fixed, to the oil pan 4, the separator 5 is inserted into the oil pan 4 such that the rubber lip 14 on the plate 13 is elastically deformed to closely contact the inner wall 10 of the oil pan 4. The oil pan 4 has such a shape that the distance between the opposed faces of the inner wall 10 decreases toward the lower end. Therefore, by pressing the separator 5 toward the bottom of the oil pan 4, the rubber lip 14 is caused to tightly contact the inner wall 10 of the oil pan 4. As a result, the separator 5 is attached to the oil pan 4 while sealing the outer sump 7.

The above described embodiment has the following advantages.

(1) Oil trickling down the inner wall of the cylinder block 1 is restricted from entering the outer sump 7, so that the oil in the inner sump 6 is allowed to be easily heated. The present embodiment includes the plate 13, which is smaller in size than the separator 5 and is easy to handle, and the rubber lip 14 for sealing the outer sump 7 is attached to the plate 13. The plate 13 is fixed to the separator 5. This allows the rubber lip 14 to be easily attached to the separator 5.

(2) The plate 13 is fixed to the separator 5 by heat-swaging. This allows the rubber lip 14 to be easily arranged at a desired position on the separator 5 and facilitates the work.

(3) The rubber lip 14, which seals the outer sump 7, is easily elastically deformed to conform to the shape of the inner wall 10 of the oil pan 4. This allows the rubber lip 14 and the inner wall 10 to tightly contact each other, thereby further improving the sealing property of the outer sump 7.

(4) The plate 13 has a ring-like shape, and the rubber lip 14 is attached to the entire perimeter of the plate 13. The rubber lip 14 closely contacts the inner wall 10 of the oil pan 4. This improves the sealing property of the outer sump 7, thereby allowing the oil to be more easily heated.

The above illustrated embodiment may be modified as follows.

In the above illustrated embodiment, the rubber lip 14 is attached to the perimeter of the plate 13. However, as long as the outer sump 7 can be sealed, the manner in which the rubber lip 14 is attached is not limited.

The plate 13 does not necessarily need to have a ring-like shape, but may be split into several pieces. In this case, a rubber lip is attached to each of the pieces.

In the illustrated embodiment, a rubber lip is employed as a sealing member for sealing the outer sump 7. However, other types of sealing members such as a liquid gasket may be employed. This configuration also achieves the same advantages as the above described advantages (1) and (2).

In the illustrated embodiment, plastic is used as the material of the plate 13. However, the plate 13 may be made of other material such as metal.

In the above illustrated embodiment, the separator 5 and the plate 13 are fixed to each other by the heat-swaging. However, if metal is used as the material of the plate 13, the plate 13 may be mechanically swaged to be fixed to the separator 5.

In the illustrated embodiment, the separator 5 and the plate 13 are fixed to each other by swaging. However, the separator 5 and the plate 13 may be fixed to each other by other methods. For example, adhesive may be applied to the separator 5 and the plate 13 and the separator 5 and the plate 13 may be bonded to each other. The separator 5 and the plate 13 may also be welded to each other. Alternatively, the separator 5 and the plate 13 may be fastened to each other with bolts. As other methods for fixing, the protrusions 12 of the separator 5 may be formed with hooks and the plate 13 may be fixed to the separator 5 by snap-fitting. Further, the separator 5 and the plate 13 may be integrated with clips. These configurations at least achieve the same advantage as the advantage (1).

The invention claimed is:

1. A double sump oil pan comprising:

a separator made of plastic that partitions an interior of the oil pan into an inner sump and an outer sump, and the separator has a protrusion;

a plate that has an insertion hole, which receives the protrusion; and an elastically deformable sealing member attached to the plate, wherein the sealing member contacts an inner wall of the oil pan, thereby sealing the outer sump, and the plate and the separator are fixed to each other by heat-swaging the protrusion.

2. The double sump oil pan according to claim 1, wherein the sealing member is a rubber lip.

3. The double sump oil pan according to claim 1, wherein the plate has a ring-like shape, and the sealing member is attached to an entire perimeter of the plate.

4. A double sump oil pan comprising:

a separator that partitions an interior of the oil pan into an inner sump and an outer sump;

a plate; and an elastically deformable seal attached to the plate, wherein the seal contacts an inner wall of the oil pan along which oil flows down, and the seal guides the oil directly on a face of the seal to go down the face of the seal and away from the inner wall, thereby sealing the outer sump, the face of the seal includes at least a portion that declines, with respect to a vertical direction relative to the ground, toward the inner sump, and the plate and the separator are fixed to each other.

5. The double sump oil pan according to claim 4, wherein the separator has a protrusion, the plate has an insertion hole, which receives the protrusion, and the plate and the separator are fixed to each other by heat-swaging the protrusion.

6. The double sump oil pan according to claim 4, wherein the seal is a rubber lip.

7. The double sump oil pan according to claim 4, wherein the plate has a ring-like shape, and the seal is attached to an entire perimeter of the plate.

8. The double sump oil pan according to claim 4, wherein the separator is made of plastic.

9. The double sump oil pan according to claim 4, wherein the seal seals a gap between the separator and the inner wall of the oil pan.

10. The double sump oil pan according to claim 4, wherein one or more side wall of the separator includes at least one through hole to permit a communication of the oil between the inner and outer sumps, and a bottom wall of the separator does not include any through hole.

11. The double sump oil pan according to claim 4, wherein the plate includes an inward portion that declines, with respect to the vertical direction relative to the ground, toward the inner sump.

12. A double sump oil pan comprising: a separator that partitions an interior of the oil pan into an inner sump and an outer sump; a plate; and an elastically deformable seal attached to the plate, wherein the seal contacts an inner wall of the oil pan along which oil flows down, and the seal guides the oil directly on a face of the seal to go down the face of the seal and away from the inner wall, thereby sealing the outer sump, the face of the seal includes at least a portion that extends in a vertical direction relative to the ground, and the plate and the separator are fixed to each other.

* * * * *